US006895674B2

(12) United States Patent
Ai

(10) Patent No.: US 6,895,674 B2
(45) Date of Patent: May 24, 2005

(54) ROOFING UTILITY BLADE FOR ROOFING KNIFE

(76) Inventor: Jeffrey S. Ai, 409 Nihoa St., Kahului, HI (US) 96732

( * ) Notice: Subject to any disclaimer, the term of this patent is extended or adjusted under 35 U.S.C. 154(b) by 45 days.

(21) Appl. No.: 10/641,095

(22) Filed: Aug. 15, 2003

(65) Prior Publication Data

US 2005/0034312 A1 Feb. 17, 2005

(51) Int. Cl.[7] ..... B26B 9/00
(52) U.S. Cl. ..... 30/353; 30/162; 30/314
(58) Field of Search ..... 30/353, 2, 162, 30/314, 345, 163, 335, 336, 346.57, 346.61, 351, 357, 136, 142, 143–149, 125; 15/105, 236.05, 245.1, 236.01; D7/688, 649–651; D8/45, 16, 19; D32/40, 42, 46, 47, 49

(56) References Cited

U.S. PATENT DOCUMENTS

| | | | | | |
|---|---|---|---|---|---|
| 1,464,681 | A | * | 8/1923 | Mitchell | 30/153 |
| 1,748,637 | A | * | 2/1930 | Crum | 30/162 |
| 1,748,638 | A | * | 2/1930 | Crum | 30/162 |
| D163,562 | S | * | 6/1951 | Bjork | D22/3 |
| 2,631,372 | A | * | 3/1953 | Fournier | 30/320 |
| 3,241,236 | A | * | 3/1966 | Capps | 30/287 |
| 4,100,677 | A | * | 7/1978 | Jeff | 30/321 |
| 4,507,867 | A | * | 4/1985 | Haas, Jr. | 30/90.4 |
| 4,821,609 | A | * | 4/1989 | Rushbrook et al. | 81/45 |
| 5,075,973 | A | * | 12/1991 | Borner | 30/279.5 |
| 5,093,994 | A | * | 3/1992 | Karas | 30/125 |
| 5,107,593 | A | | 4/1992 | Hutchins | |
| 5,437,074 | A | * | 8/1995 | White et al. | 15/105 |
| 5,720,105 | A | | 2/1998 | Gates | |
| 5,870,828 | A | * | 2/1999 | Polites | 30/162 |
| 5,906,049 | A | * | 5/1999 | Butts | 30/125 |
| 6,148,522 | A | | 11/2000 | Dobandi | |
| 6,505,403 | B1 | * | 1/2003 | Andrews | 30/29.5 |
| 2003/0106220 | A1 | * | 6/2003 | Caldwell | 30/49 |

FOREIGN PATENT DOCUMENTS

| | | |
|---|---|---|
| FR | 1218889 | 12/1959 |

* cited by examiner

*Primary Examiner*—Allan N. Shoap
*Assistant Examiner*—Alie Ghassem
(74) *Attorney, Agent, or Firm*—Richard C. Litman

(57) ABSTRACT

A utility blade especially adapted for a roofing knife. The blade is fabricated from a flat, thin blank of metallic material and has a square central mounting hole for mounting in a conventional roofing knife. A first end of the blade is configured with a curvilinear, sharpened hook on one side and a V-shaped sharpened cutting component on the other side. The V-shaped sharpened cutting component terminates into a sharpened point. This arrangement is effective to give a user the advantage of having two different type cutting surfaces in one blade.

1 Claim, 3 Drawing Sheets

ROOFING UTILITY BLADE FOR ROOFING KNIFE

BACKGROUND OF THE INVENTION

1. Field of the Invention

The present invention generally relates to hand tools. More specifically, the present invention is drawn to a unique blade for a utility knife, which blade is especially adapted for cutting and manipulating roofing tile.

2. Description of the Related Art

Utility knives and blades therefor have been the subject of numerous patents. For example, U.S. Pat. No. 5,107,593 (Hutchins) discloses a utility knife having a blade designed and bent to be useful as a scraper. The instant blade could not be used to efficiently cut tile.

U.S. Pat. No. 5,437,074 (White et al.) is drawn to a tool having curved and hooked surfaces. The tool is designed to remove caulk and does not present edges sharp enough to cut tile.

U.S. Pat. No. 5,720,105 (Gates), U.S. Pat. No. 6,148,522 (Dobandi) and French patent 1,218,889 show utility knives which incorporate multi-purpose blades. The blades do not have the unique configuration as required by the blade of the instant invention.

None of the above inventions and patents, taken either singly or in combination, is seen to disclose a utility blade especially designed for roofing as will subsequently be described and claimed in the instant invention.

SUMMARY OF THE INVENTION

The present invention is drawn to a roofing utility blade especially adapted for a roofing knife. The blade is fabricated from a flat, thin blank of metallic material and has a square central mounting hole for mounting in a conventional roofing knife. A first end of the blade is configured with a curvilinear, sharpened hook on one side and a V-shaped sharpened cutting component on the other side. This arrangement is effective to give a user the advantage of having two different type cutting surfaces in one blade without changing knives or blades. The other end of the blade is mirror image of the first end, thereby permitting a user to easily provide a fresh cutting end when the first end becomes dull.

Accordingly, it is a principal object of the invention to provide an improved blade for a utility knife.

It is another object of the invention to provide an improved blade for a utility knife, which blade has multiple cutting surfaces at each end.

It is a further object of the invention to provide an improved blade for a utility knife, which blade is especially adapted for cutting roofing tile.

Still another object of the invention is to provide an improved blade for a utility knife, which blade is fabricated from durable material.

It is an object of the invention to provide improved elements and arrangements thereof for the purposes described which are inexpensive, dependable and fully effective in accomplishing their intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 1:
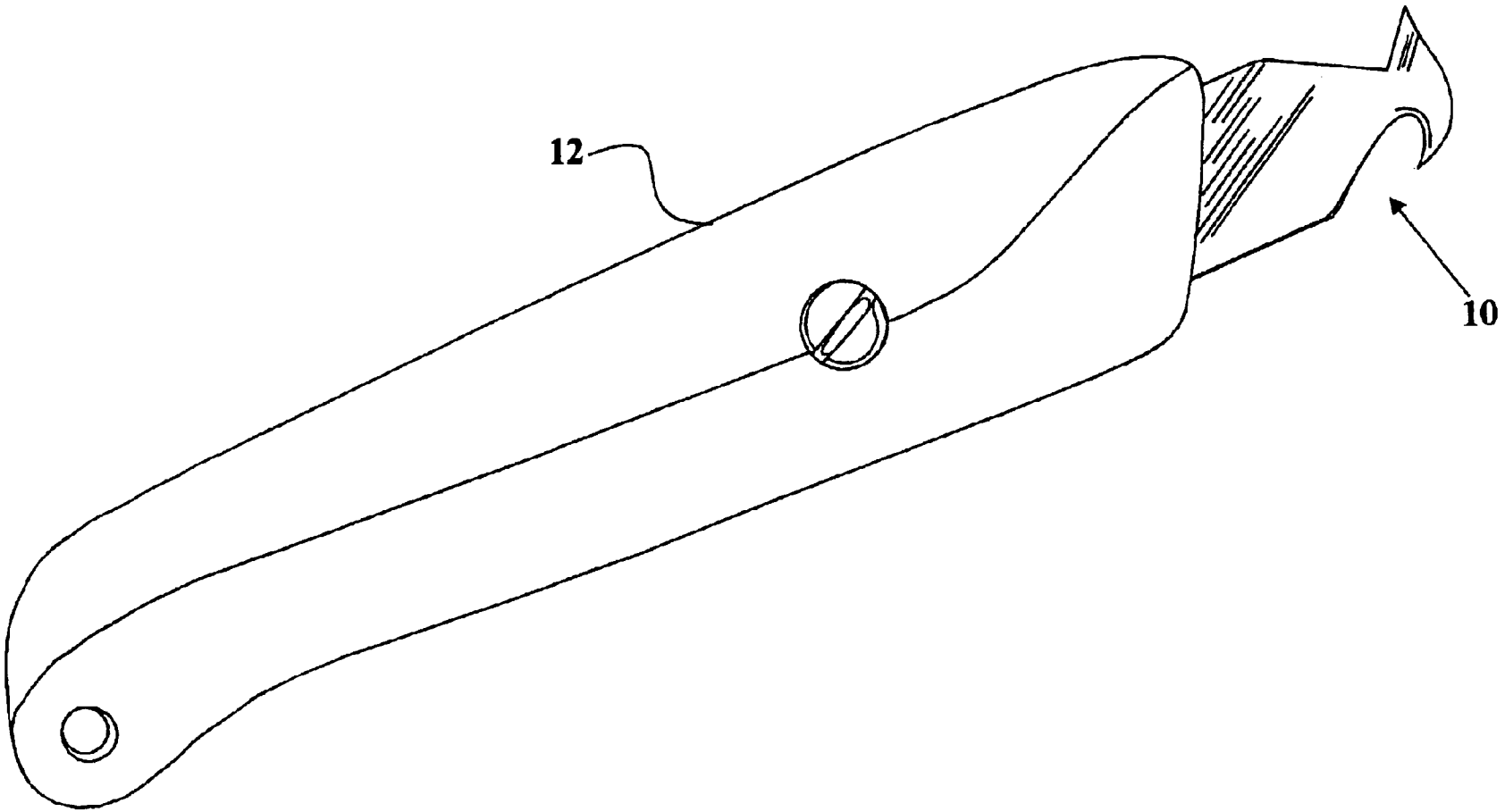
FIG. 1 is an environmental, perspective view of a roofing utility blade for a roofing knife according to the present invention.
Figure 2:
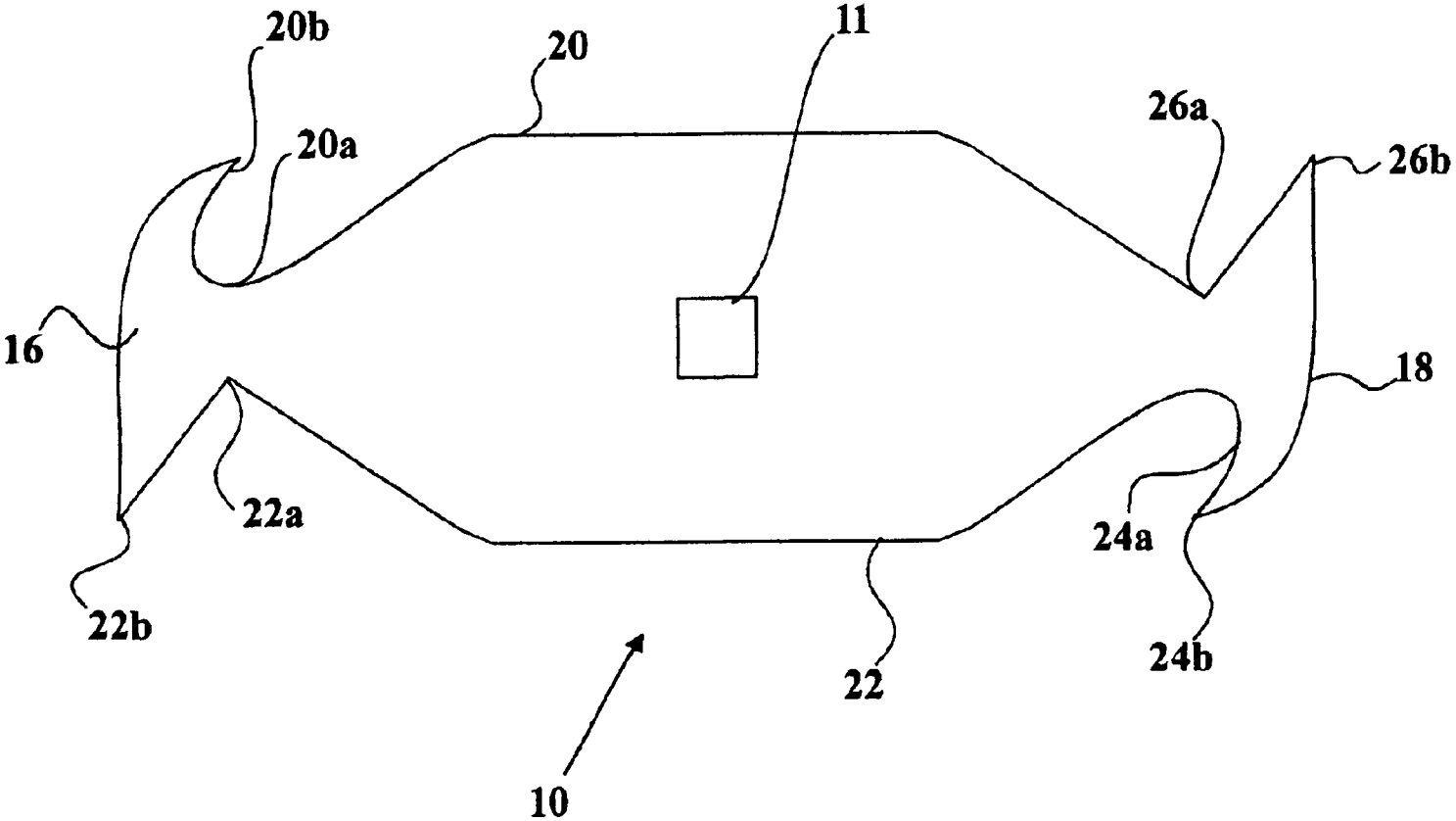
FIG. 2 is a plan view of a roofing utility blade according to the present invention.

Attention is first directed to FIG. 1 wherein the blade of the present invention is generally indicated at 10. The blade 10 is mounted in a roofing blade or knife holder 12 in the usual manner. The holder is conventional and includes a storage compartment (not shown) for retaining extra blades. As best seen in FIG. 2 a first embodiment blade 10 is fabricated from a flat, thin blank of metallic material, preferably heat-treated carbon steel. A square opening 11 is disposed through the body of the blank at a central area thereof. The blade is constructed to have a proximate end 16, a distal end 18, a first edge 20 and a second edge 22. A curvilinear portion 20*a* is formed in the first edge 20 adjacent the proximate end 16 and terminates in a sharpened hook portion 20*b*. A V-shaped sharpened cutting component 22*a* is formed in the second edge 22 adjacent the proximate end 16 and terminates in a sharpened point 22*b*.

Distal end 18 is a mirror image of proximate end 16 in that a curvilinear portion 24*a* is formed in the second edge 22 adjacent the distal end 18 and terminates in a sharpened hook portion 24*b*. A V-shaped sharpened cutting component 26*a* is formed in the first edge 20 adjacent the distal end 18 and terminates in a sharpened point 26*b*.

Figure 3:
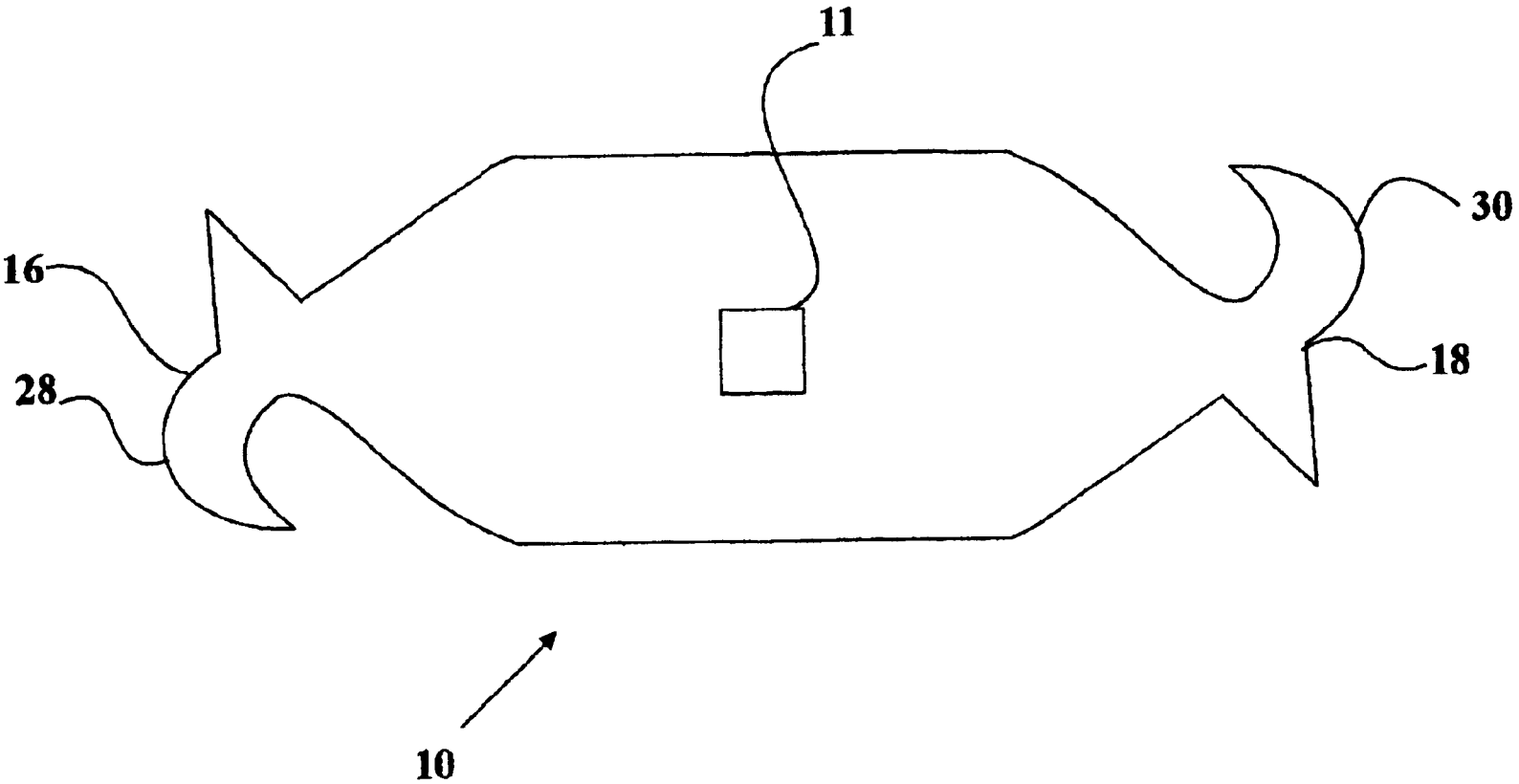
FIG. 3 is a plan view of a second embodiment of a roofing utility blade according to the present invention.

The embodiment of FIG. 3 is essentially the same as that of FIG. 2 except that arcuate cutting edges 28 and 30 are formed at each blade end.

It is to be understood that the present invention is not limited to the embodiments described above, but encompasses any and all embodiments within the scope of the following claims.

What is claimed is:

1. A roofing utility blade for a roofing knife, comprising:

a flat blank having a body portion, a proximate end, a distal end, a first side edge and a second opposing side edge;

an arcuate cutting edge defined at said proximate end;

an arcuate cutting edge defined at said distal end;

a first curvilinear portion formed in said first side edge adjacent said proximate end, said first curvilinear portion terminating in a sharpened hooked portion;

a first v-shaped sharpened cutting component formed in said second opposing side edge adjacent said proximate end, said first v-shaped sharpened cutting component terminating in a first sharpened point, a first vertex of said first v-shaped cutting component formed by the intersection of a first and a second slanted straight cutting edges, said first slanted cutting edge extending from said first side edge to said first vertex, said second slanted cutting edge extending from said first sharpened point to said first vertex;

a second curvilinear portion formed in said second opposing side edge adjacent said distal end, said second curvilinear portion terminating in a sharpened hooked portion;

a second v-shaped sharpened cutting component formed in said first side edge adjacent said distal end, said second v-shaped sharpened cutting component terminating in a second sharpened point;

a second vertex of said second v-shaped cutting component formed by the intersection of a third and a forth slanted straight cutting edges, said third slanted cutting edge extending from said second opposing side edge to said second vertex, said forth slanted cutting edge extending from said second sharpened point to said second vertex; and an opening disposed through said body portion at central area of said flat blank between said first and second side edges and said proximate and distal ends.

* * * * *